US007655885B2

(12) United States Patent
Kim et al.

(10) Patent No.: US 7,655,885 B2
(45) Date of Patent: Feb. 2, 2010

(54) OVEN

(75) Inventors: Jong Sik Kim, Seoul (KR); Yang Kyeong Kim, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/609,480

(22) Filed: Dec. 12, 2006

(65) Prior Publication Data

US 2007/0187387 A1 Aug. 16, 2007

(30) Foreign Application Priority Data

Dec. 12, 2005 (KR) ..... 10-2005-0121555

(51) Int. Cl.
*F24C 15/04* (2006.01)
*F24C 15/32* (2006.01)
*A21B 3/02* (2006.01)

(52) U.S. Cl. ..... 219/391; 126/198; 126/200

(58) Field of Classification Search ..... None
See application file for complete search history.

(56) References Cited

U.S. PATENT DOCUMENTS 3,681,557 A * 8/1972 Suzuki et al. ..... 126/190
4,520,791 A * 6/1985 Chamberlain ..... 126/198
6,904,904 B2 * 6/2005 Walther et al. ..... 126/198
7,126,097 B2 10/2006 Kim et al.
2004/0159317 A1 * 8/2004 Walther et al. ..... 126/200
2005/0076900 A1 * 4/2005 Walther et al. ..... 126/198
2005/0133019 A1 * 6/2005 Kim et al. ..... 126/198
2005/0224068 A1 * 10/2005 Kim et al. ..... 126/198
2007/0017387 A1 1/2007 Kim et al.

FOREIGN PATENT DOCUMENTS

GB 2186967 A * 8/1987

OTHER PUBLICATIONS

U.S. Appl. No. 11/459,706 to Kim et al., which was filed on Jul. 25, 2006.
U.S. Appl. No. 11/615,370 to Kim et al., which was filed on Dec. 22, 2006.
U.S. Appl. No. 11/564,490 to Kim et al., which was filed on Nov. 29, 2006.

* cited by examiner

*Primary Examiner*—Joseph M Pelham
(74) *Attorney, Agent, or Firm*—McKenna Long & Aldridge LLP

(57) ABSTRACT

An oven is provided. The oven includes a cavity, a door panel that covers the cavity, and a side frame that supports a side of the door panel. The side frame and the door frame form an outside air intake hole therebetween.

11 Claims, 8 Drawing Sheets

OVEN

BACKGROUND OF THE INVENTION

1. Field of the Invention

The present invention relates to an oven, and more particularly, to an oven door structure for an oven with a door frame having improved cooling performance.

2. Description of the Related Art

Generally, an oven is a cooking apparatus that cooks food placed within a cavity by applying heat generated by a heater Specifically, the cavity can be selectively opened and closed by means of a door pivotably installed at the front of the oven. Also, the door has a skeletal frame on which a door panel and other components are attached.

In ovens according to the related art, in order to cool the door, a separate cooling passage is formed separately within the door. This cooling passage cools the door using air flowing through the passage from the outside of the oven. An exemplary embodiment of such an oven is a structure that suctions outside air at the bottom of the door and circulates the air through the door panel and out through the rear of the cavity. Also, the air is passed from the upper portion of the cavity through an exhaust passage formed in the upper portion of the door to the outside of the oven.

However, in the conventional method of simply forming air passages in the door is ineffective in cooling the door.

Especially in door frames made of metal material, the prodigious amount of heat conducted from inside the cavity to the frame is absorbed by the frame, where the structure for radiating the heat absorbed by the frame cannot provide adequate cooling. Accordingly, heat in the door frame cannot be sufficiently radiated to the outside, so that cooling effectiveness of the door is reduced.

SUMMARY OF THE INVENTION

Accordingly, the present invention is directed to an oven that substantially obviates one or more problems due to limitations and disadvantages of the related art.

An object of the present invention is to provide an oven door having a structure capable of easily discharging heat transferred from the cavity to the door frame.

Another object of the present invention is to provide a oven door having a structure capable of reducing the amount of heat transferred from inside the cavity to the door frame.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an oven, including: a cavity; a door panel for covering the cavity; and a side frame supporting a side of the door panel, wherein the side frame and the door frame form an outside air intake hole therebetween.

In another object of the present invention, there is provided an oven including: a cavity; a door panel including an inner panel covering the cavity and exposed to an inner space of the cavity, an outer panel exposed to an outer space, and at least one or more middle panels provided between the inner panel and the outer panel; and a door frame fixed at a predetermined distance from the outer panel, for supporting the inner panel and the one or more middle panels.

In a further object of the present invention, there is provided an oven including: a cavity forming a cooking space within; and a door for covering a front opening portion of the cavity, and including a plurality of door panels arranged in a front-to-rear direction apart from one another at a predetermined distance, a side frame supporting sides of the door panels, a mold portion coupled to both ends of the side frame, and an upper frame coupled to upper ends of the door panels, wherein a surface of the side frame is concaved a predetermined depth, and forms an air receiving hole that is covered by a door panel that is exposed to an inner space of the cavity, from the plurality of door panels.

In the above-structured oven door according to the present invention, an air receiving hole is formed as a sealed space within the door frame. Thus, the area of the first door panel that directly contacts the cavity and receives heat contacting the side frame is reduced, so that the amount of heat transferred through the cavity is effectively reduced.

Also, the receiving hole within which inner air is filled blocks the transfer of heat radiated from the cavity, to act as a thermal blocking layer. Accordingly, the amount of heat transferred from the cavity to the side frame is effectively reduced.

Also, in the structure of the oven door according to the present invention, outside air enters the respective spaces formed between the second door panel, the third door panel, and the fourth door panel, so that heat transferred from the cavity to the door frame can easily be dissipated.

Furthermore, in the oven door structure according to the present invention, outside air enters and contacts an outer valley protrusion, an inner valley protrusion, a concave protrusion, and the second outer protrusion, and other similar fin portions. The fin portions, being portions protruding from the side frame, enlarges the surface that the moving air contacts. Accordingly, the air moving within the side frame exchanges heat with the fin portions. That is, the amount of heat radiated from the side frame is increased, thereby increasing cooling effectiveness.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
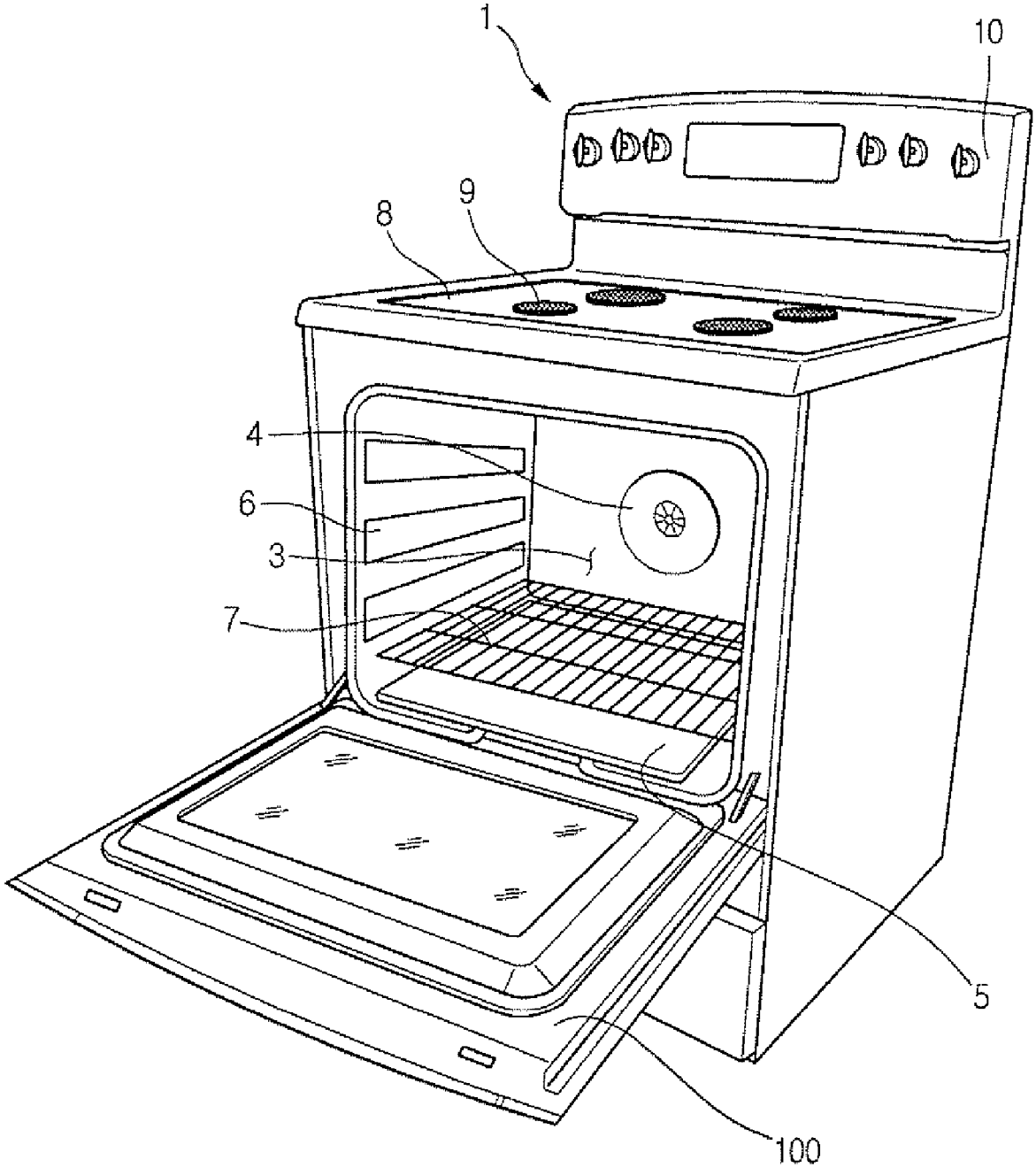
FIG. 1 is a perspective view of an oven according to the present invention.

FIG. 1 is a perspective view of an oven according to the present invention.

Referring to FIG. 1, an oven 1 according to the present invention includes a cavity 3 forming an inner cooking space within, a door 100 pivotably installed at the front opening of the cavity 3, a convection heater (not shown) provided at the rear interior of the cavity 3 for generating heat, and a convection fan 4 for diffusing the heat generated by the convection fan throughout the inside of the cavity 3.

In further detail, a sealing member 11 surrounds the edges at the front of the cavity 3. The sealing member 11 seals the space between the door 100 and the cavity 3. The sealing member 11 is installed on the front case 12 of the oven 1, which is fixed to a side case 13.

Also, both sides of the cavity 3 have one or more rack guides 6 formed thereon for inserting at least one or more racks 7. Specifically, the rack 7 is for placing containers holding food on, and is guided by the rack guide 6 to slide forward and backward into and out of the cavity 3.

Furthermore, a bake heater (not shown) that is a heat source is provided at the bottom of the cavity 3, and a double floor 5 is coupled at the top of the bake heater. In detail, the double floor 5 prevents the bake heater from being exposed to the outside during cooking. Accordingly, the possibility of a user suffering burns due to contacting an exposed bake heater is prevented.

The oven 1 also has a cook top 8 formed on its upper surface, at least one or more cook top heaters 9 formed on the cook top 8, and a control panel 10 formed at the rear of the cook top 83 Specifically, the cook top heater 9 converts electrical energy to thermal energy when operating, to provide heat to containers placed thereon holding food. Also, the control panel 10 provides various control buttons, etc., and enables controlling of the operations of each operating unit of the oven 1 from the outside.

Figure 2:
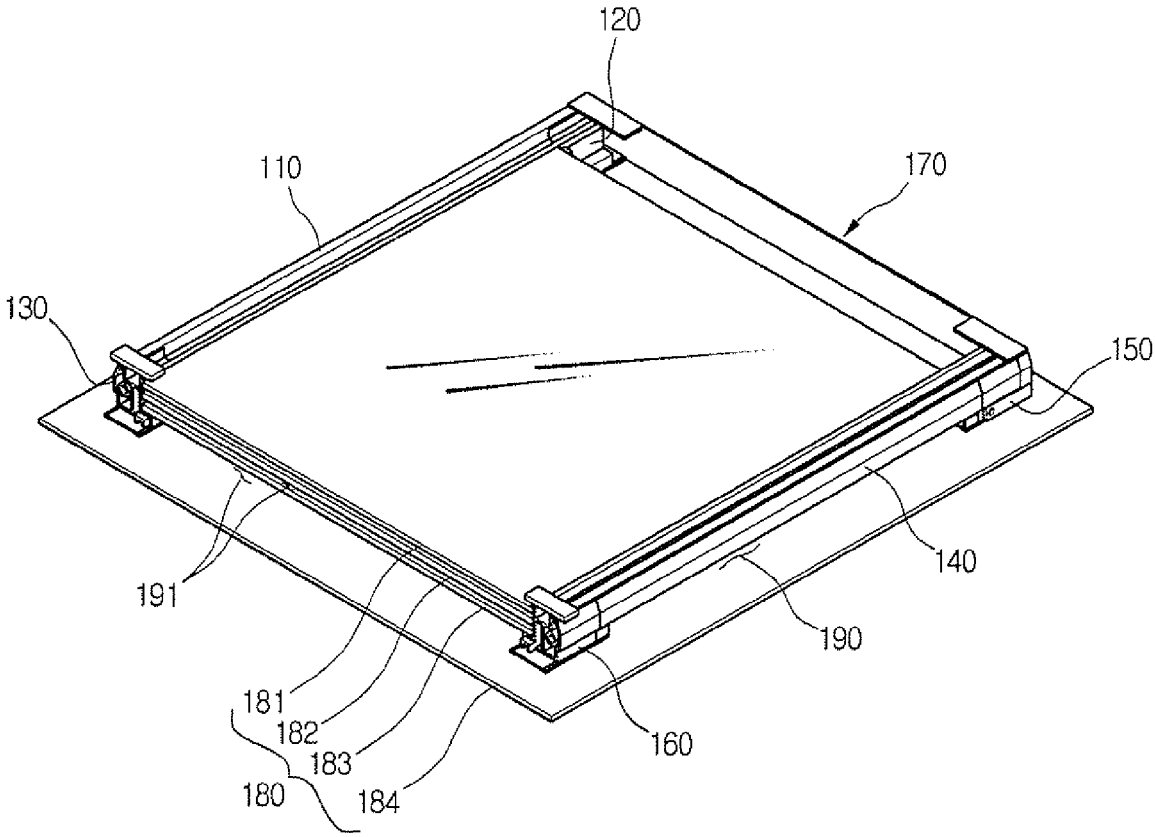
FIG. 2 is a perspective view of an oven door viewed from the rear thereof.

FIG. 2 is a perspective view of an oven door viewed from the rear thereof.

Referring to FIG. 2, a door 100 of an oven 11 according to the present invention includes a side frame 200 forming the skeleton of the door 100, an upper frame 170 connected to the side frame 200, an upper left mold frame 120 and an upper right mold frame 150 supporting the upper ends of the side frame 200, a lower right mold frame 160 and a lower left mold frame 130 supporting the lower ends of the side frame 200, and a door panel 180 for separating the cavity 3 from the outside of the oven 1.

In detail, the side frame 200 forms a side skeleton of the door 100 to support the door panel 180. Also, the side frame 200 may be formed of a metal material having a predetermined hardness. This side frame 200 may be coupled to a portion of the door panel 180.

The door panel 180 is coupled at a distance apart from the side frame 200, and forms a side intake 190 that is part of the cooling passage of the door 100. Also, the upper frame 170 is disposed at the upper portion of the door panel 180, and supports the door panel 180. The upper frame 170 forms an upper exhaust that is a part of the cooling passage of the door 100, and exhausts air that flows along the inside of the door panel 180 and absorbs heat transferred from the cavity 3.

The mold frames 120, 130, 150, and 160 are disposed respectively at each corner of the door panel 180, and are coupled to the side frame 200. In detail, the mold frames 120, 130, 150, and 160 may be formed of a plastic material having low thermal conductivity, versus a metal material. Thus, the mold frames 120, 130, 150, and 160 can block the heat that is transferred from the cavity 3 to the side frame 200, preventing the entire door from being heated.

Here, the mold frames 120, 130, 150, and 160 are made of plastic, and the side frame 200 is made of metal; however, this is only exemplary. That is, a variety of embodiments, in which the mold frames 120, 130, 150, and 160 and the side frame 200 are made of materials having different thermal conductivity, so that they block the transfer of heat and prevent the heating of the entire door 100, are possible.

Also, the mold frames 120, 130, 150, and 160 are disposed at the corners of the door 100, and specifically, at the corners of the door panel 180. This arrangement effectively prevents the heat from the side panel 200 from being transferred to the entire door 100.

The door panel 180 may be provided in plurality. That is, the a first door panel 181 may be disposed near the cavity 3, and a second, third, and fourth door panel 182, 183, and 184 may be respectively provided in sequence thereafter at a predetermined distance from the first door panel 181, and then the next door panel, and so forth. Also, the fourth door panel 184, that is disposed the farthest outward, directly contacts the air outside the oven 1, that is, indoor air; and the first door panel 181 that is the farthest inward contacts the air within the cavity 3.

Between each of the panels of the door panel 180, a predetermined gap exists, forming air passages. From these, the air passages formed between the second and third door panels 182 and 183, and the third and fourth door panels 183 and 184 become door cooling passages 191. That is, when outside air enters through the lower portion of the door 100, the air rises through the door cooling passage 191. Thus, the door 100 is cooled by the outdoor air that enters.

Here, according to this embodiment, outside air also enters through the side portions of the door 100 to cool the door 100. Specifically, the side frame 200 is disposed at the rear of the fourth door panel 184 by a predetermined distance, and the side intake 190 is formed in that gap. Also, when the flow of air is formed along the door cooling passage 191, outside air also flows in through the side intake 190 to cool the door 100. Accordingly, the door 100 according to the present invention is quickly cooled.

Figure 3:
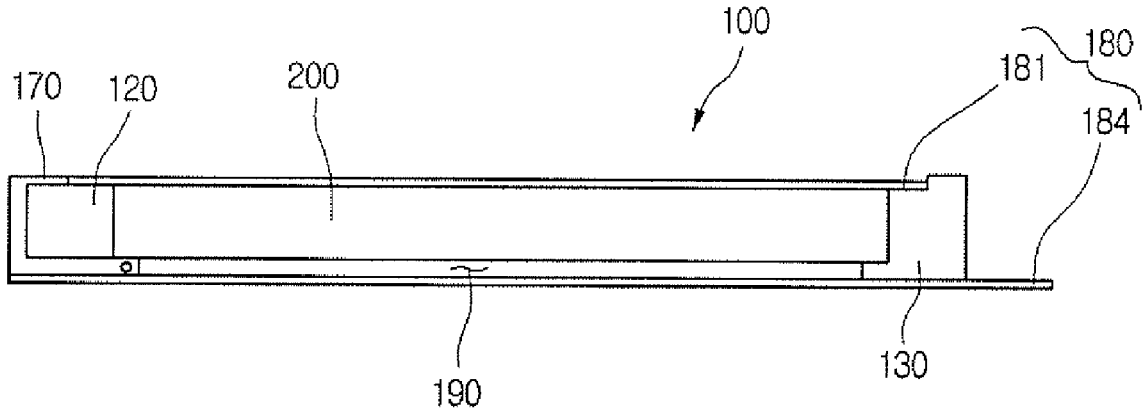
FIG. 3 is a side view of a door according to the present invention.

FIG. 3 is a side view of a door according to the present invention.

Referring to FIG. 3, the side intake 190 is formed on the side surface of the door 100, according to the present invention. The side intake 190 is a space formed by a predetermined gap between the fourth door panel 184 and the side frame 200 when the side frame 200 is coupled to the molding frames 120 and 130. Also, the side intake 190 becomes an intake for air in order to cool the door 100. Therefore, the side intake 190 is formed, allowing cooling of the door 100 through its side. Accordingly, the side intake 190 is formed to allow double cooling from the side and bottom of the door 100, thereby increasing the cooling effectiveness of the door 100, FIG. 4 is an exploded perspective view of a door frame according to the present invention.

Figure 4:
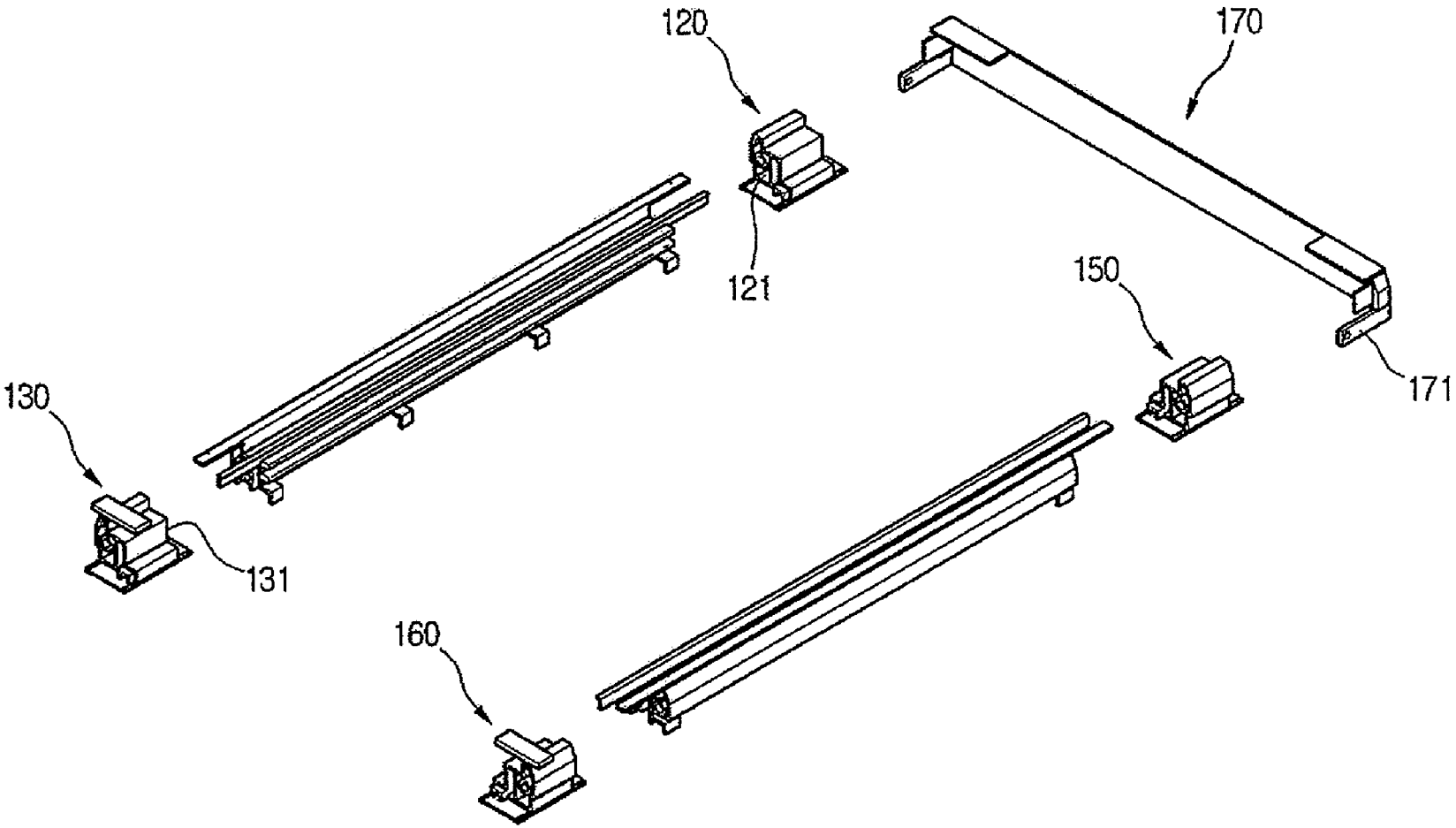
FIG. 4 is an exploded perspective view of a door frame according to the present invention.

Referring to FIG. 4, the door frame according to the present invention includes a side frame 200 supporting the sides of the door panel 180, an upper frame 170 coupled above the side frame 200, and mold frames 120, 130, 150, and 160 connecting the side frame 200 to the upper frame 170. Also, the mold frames 120, 130, 150, and 160 are coupled to each end portion of the side frame 200 to support the corners of the door panel 180.

In detail, the side frame 200 and the upper frame 170 and the mold frames 120, 130, 150, and 160 all have respectively coupling portions.

Figure 5:
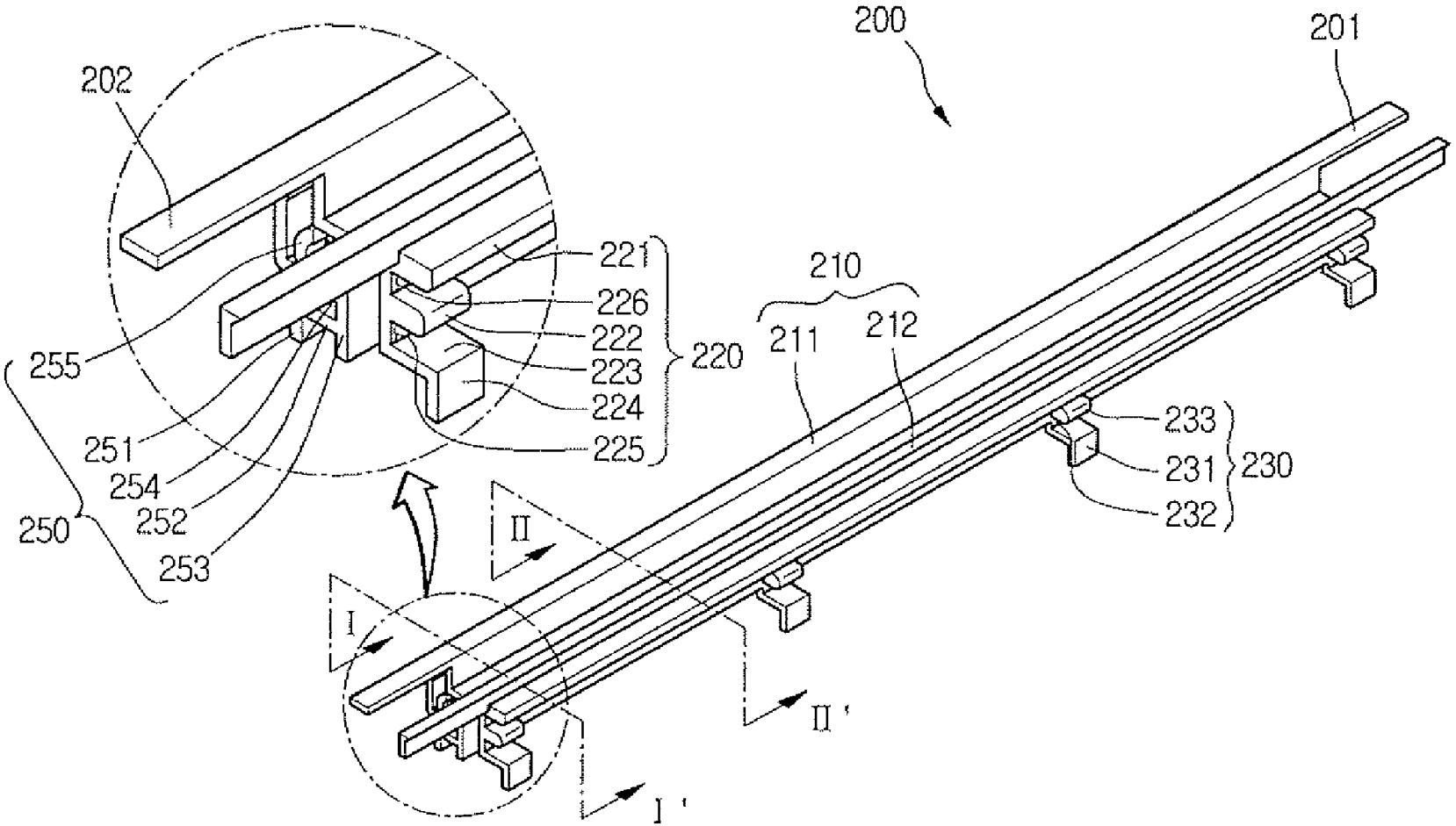
FIG. 5 is a perspective view of a side frame forming a door frame according to the present invention.

In further detail and referring to FIG. 5, both ends of the side frame 200 respectively have coupling protrusions 201 and 202 that protrude a predetermined length formed thereon. Also, the lower end of the upper frame 170 has a coupling protrusion 171 formed thereon to protrude a predetermined length.

Additionally, the mold frames 120 and 130 form coupling receptacles 121 and 131 for receiving the coupling protrusions 201, 202, and 171. Accordingly, the side frame 200 and the upper frame 170 organically couple with the mold frames 120 and 130 therebetween, through the inserting of the coupling protrusions 201, 202, and 171 in the coupling receptacles 121 and 131.

Additionally, in the above-described coupling structure, the side frame 200 can easily be dismantled from the mold frames 120 and 130. That is, the side frame 200 is coupled to a portion of door panel 180, so that it may be installed on the door 100 or disassembled from the door 100. Accordingly, through the disassembly of the side frame 200, a portion of the panels of the door panel 180 may be disassembled. Due to this assembly structure, accessibility to the inside of the door 100 is improved, thereby facilitating cleaning of the door 100.

Figure 6:
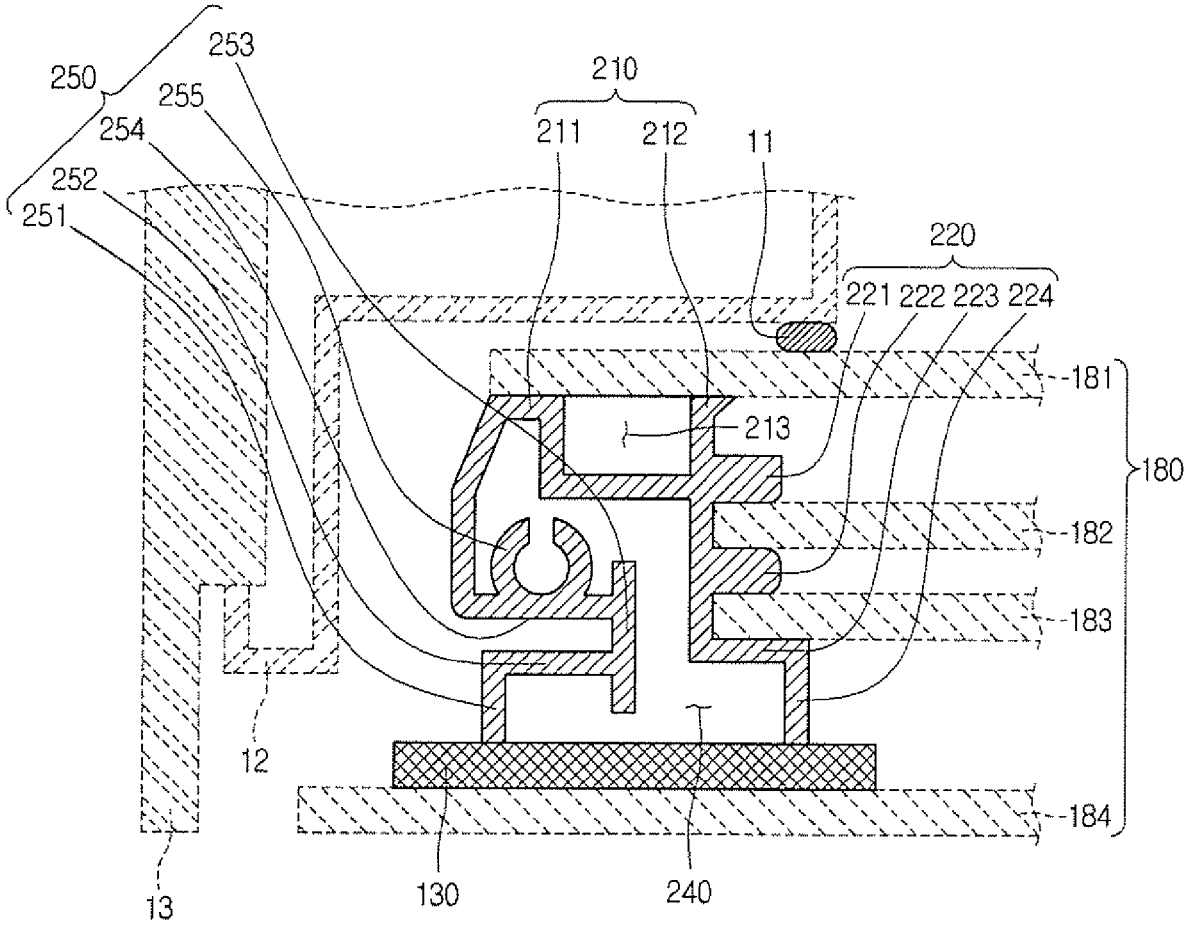
FIG. 6 is a sectional view of FIG. 5 taken along line I-I'.

FIG. 5 is a perspective view of a side frame forming a door frame according to the present invention, and FIG. 6 is a sectional view of FIG. 5 taken along line I-I'.

Referring to FIGS. 5 and 6, the side frame 200 includes a supporting portion 210 installed above the first through fourth panels 181 through 184, an end fixing portion 220, and a middle fixing portion 230 and a heat radiating portion 250 to relay heat.

In detail, the supporting portion 210 is formed on one side of the side frame 200. The supporting portion 210 is formed of an outer supporting portion 211 and an inner supporting portion 212 that are spaced a predetermined distance apart. Also, the outer supporting portion 211 and the inner supporting portion 212 have a first door panel 181 mounted thereon.

A space forming hole 213 (FIG. 6) is formed between the inner and outer supporting portions 212 and 211 and the first door panel 181. In detail, the space forming hole 213 is a space that is sealed from the outside. That is, by forming the space forming hole 213, the contacting area between the first door panel 181 directly contacting the cavity 3 and receiving heat therefrom and the side frame 200 is reduced. Also, the air in the space forming hole 213 acts as a thermal barrier layer that blocks the transfer of heat from the cavity 3. Accordingly, the amount of heat transferred from the cavity 3 to the side frame 200 is reduced. Therefore, the side frame 200 is effectively prevented from receiving heat from the cavity 3 and becoming heated.

Also, both ends of the side frame 200 have end fixing portions 220 formed thereon. In detail, the end fixing portions 220 include first, second, and third fixing portions 221, 222, and 223, and a frame fixing portion 224 bent at the end of the third fixing portion 223 and fixed to the lower left mold frame 130 or the upper left mold frame 120. Also, the first, second, and third fixing portions 221, 222, and 223 protrude predetermined distances, and the first fixing portion 221 is formed along the length of the side frame 200 from one end thereof to the other, Also, a second panel receiving groove 226 for the end of the second door panel 182 to be inserted therein is formed between the first fixing portion 221 and the second fixing portion 222. Likewise, a third panel receiving groove 225 for receiving the end of the third door panel 183 inserted therein is formed between the second fixing portion 222 and the third fixing portion 223. Accordingly, the ends of the second door panel 182 and the third door panel 183 are fixed by means of the fixing portion 220 to the side frame 200.

A plurality of middle fixing portions 230 are arranged at a predetermined interval on the side frame 200. In other words, the plurality of middle fixing portions 230 are further formed between the end fixing portions 220 formed on either end of the side frame 200. Also, as shown in FIG. 6, the central portion of the second door panel 182 is supported by the upper surface of the middle fixing portions 230 and the first fixing portion 221.

The central portion of the third door panel 183 is also supported by the middle fixing portions 230. In detail, a receiving portion 232 formed on the middle fixing portion 230 between an upper protrusion 233 formed at the upper end of the middle fixing portion 230, and the lower protrusion 231 formed below the upper fixing protrusion 233.

The third door panel 183 is securely supported by the above middle fixing portions 230.

Also, a heat radiating portion 250 is formed on the side frame 200, in order to quickly dissipate heat transferred to the side frame 200.

In more detail, the heat radiating portion 250 includes a frame fixing portion 251 fixed to the lower left mold frame 130 or the upper left mold frame 120, a first bent portion 252 bent from an end of the frame fixing portion 251, a connecting portion 253 extending in an intersecting direction with the first bent portion 252, a second bent portion 252 extending in an intersecting direction with a point on the connecting portion 253, and a concave rib 255 concaved at a predetermined curvature in an extended manner on the second bent portion 254.

More specifically, the connecting portion 253 is formed to further protrude upward and downward from a point where the first curved portion 252 connects with the second curved portion 254. Also, the concave rib 255 is formed as a circular rib having a predetermined curvature and an opening that extends from one end of the side frame 200 to the other end thereof. Also, the frame fixing portion 251 of the heat radiating portion 250 and the frame fixing portion of the end fixing portion 220 are formed to be spaced a predetermined distance apart, and are fixed to the lower left mold frame 130 and the upper left mold frame 120.

Furthermore, a cavity portion 240 is formed within the heat radiating portion 250, for outside air to enter. Also, the air that enters from the outside cools the side frame 200. In other words, the frame fixing portion 251, the first bent frame 252, the connecting portion 253, the second bent portion 254, and the concave rib 255 all function as radiating fins to quickly dissipate heat transferred from the cabinet 13 to the outside.

Figure 7:
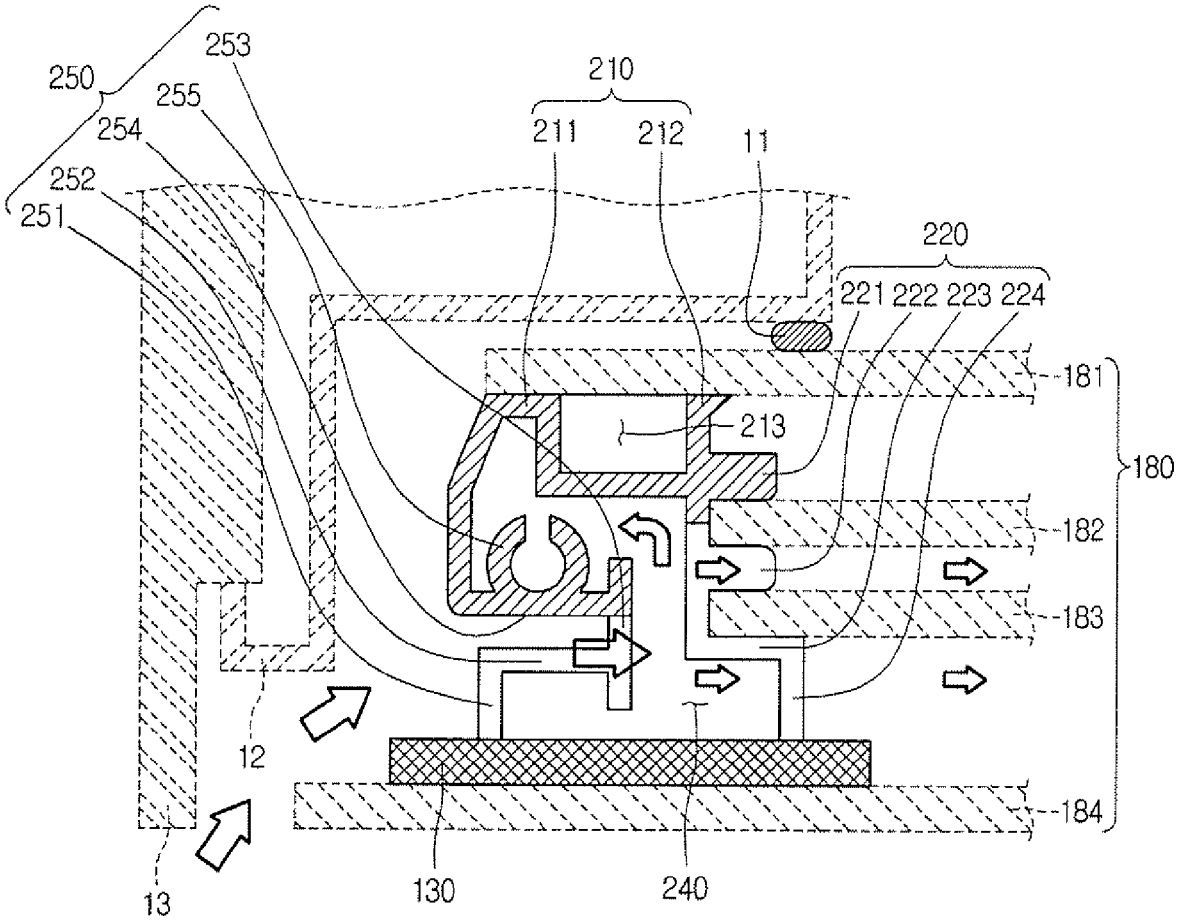
FIG. 7 is a sectional view of FIG. 5 taken along line II-II'.
Figure 8:
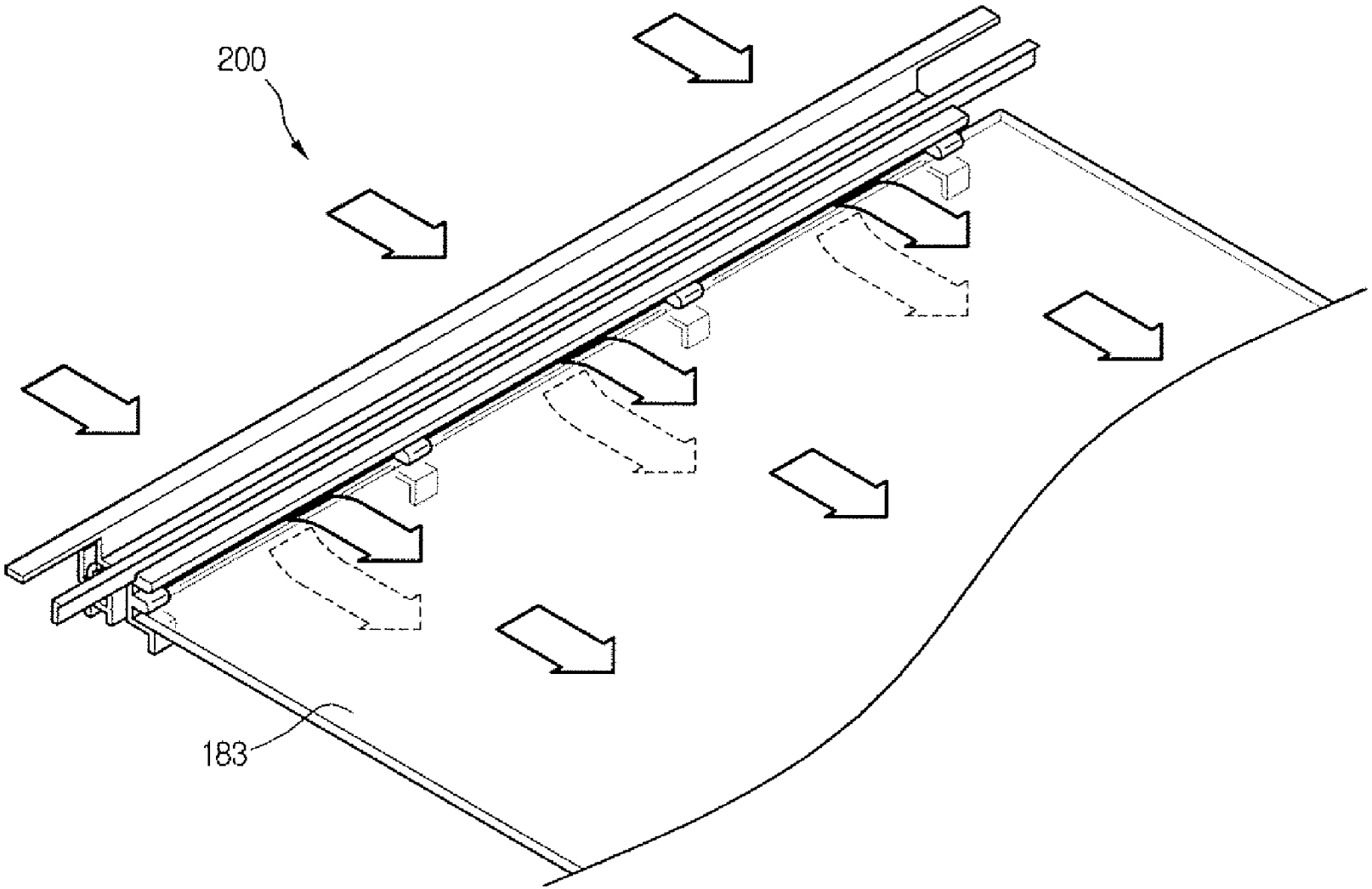
FIG. 8 is a perspective view showing the flow of air through a side from of a door according to the present invention.

FIG. 7 is a sectional view of FIG. 5 taken along line II-II', and FIG. 8 is a perspective view showing the flow of air through a side from of a door according to the present invention.

Referring to FIGS. 7 and 8, the flow of air in the side frame 200 will be described.

First, outside air enters through the space formed between the side case 13 and the front case 12 and the fourth door panel 184. The air that enters through the side intake 190 enters the door panel 180. In detail, a portion of the outside air that enters the door panel 180 flows along the space between the fourth door panel 184 and the third door panel 183. Also, a portion of the air that enters flows through the space between the second door panel 182 and the third door panel 183. Further, another portion of the outside air enters the cavity portion 240 and contacts the heat radiating portion 250. The outside air that contacts the heat radiating portion 250 absorbs the heat transferred to the side frame 200, to cool the side frame 200.

In the above flow of air, outside air flows in through spaces formed between the second door panel 182, the third door panel 183, and the fourth door panel 184, to improve the effectiveness in cooling the side frame 200 and the door panels.

Also, in the above air flow process, a portion of the outside air enters cavity portion 240 formed by the heat radiating portion 250, to exchange heat with the heat radiating portion 250. That is, each of the parts forming the heat radiating portion 250 acts as a radiating fin.

In addition, the bent portions 252 and 254 forming the heat radiating portion 250, the connecting portion 253, and the concave rib 255 are formed in the shape of fins, so that cooling effectiveness increases due to an increase in their contacting areas with outside air.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An oven comprising:

a cavity;

a door to selectively open and close the cavity, the door including:

a panel assembly including:

an inner panel covering the cavity and exposed to an inner space of the cavity;

an outer panel exposed to an outer space; and at least one or more middle panels provided between the inner panel and the outer panel, wherein the panels are spaced apart from one another; and a side frame fixed to a rear side edge of the outer panel for supporting the inner panel and the one or more middle panels, wherein an outside air intake hole is defined between the side frame and the outer panel, and wherein the outside air intake hole is configured to fluidly communicate not only with a space between the outer panel and the adjacent middle panel but also with one or more spaces respectively defined between the inner panel and the one or more middle panels, through a cavity portion of the side frame wherein the cavity portion connects the outside air intake hole and the spaces between the panels.

2. The oven according to claim 1, wherein the outside air introduced through the outside air intake hole dividedly flows toward the spaces and the cavity portion.

3. The oven according to claim 1, wherein the side frame further includes:

a supporting portion for supporting the inner panel;

a fixing portion for supporting the middle panel;

a heat radiating portion for radiating heat transferred to the side frame; and a frame fixing portion fixed to the outer panel, wherein outside air entering through the space between the side frame and the outer panel cools the panels and the side frame, and is then exhausted to an outside of the door.

4. The oven according to claim 3, wherein a plurality frame fixing portions are provided, and the plurality of frame fixing portions extend from a lower end of the side frame to form the outside air intake hole.

5. The oven according to claim 4, wherein the plurality of frame fixing portions are predetermined distances apart from each other in a longitudinal direction of the side frame.

6. The oven according to claim 3, wherein the heat radiating portion includes:

a bent portion bent a plurality of times; and a concave rib with a predetermined concave curvature, wherein at least a portion of the outside air drawn through the space between the side frame and the outer panel contacts the bent portion and the concave rib to cool the side frame.

7. The oven according to claim 6, wherein the bent portion and the concave rib protrude within the cavity portion of the side frame.

8. The oven according to claim 1, wherein a surface of each side frame is concaved a predetermined depth to form an air receiving hole, and the air receiving hole is covered by the inner panel.

9. The oven according to claim 8, wherein the air receiving hole extends from one end to the other end of the side frame.

10. The oven according to claim 8, wherein the outside air received in the air receiving hole decreases heat transfer from the cavity to the side frame.

11. The oven according to claim 1, wherein a plurality of heat radiating fins protrude within the cavity.

* * * * *